United States Patent [19]

Vrana

[11] 4,002,137

[45] Jan. 11, 1977

[54] BUOYANT WATER SCOOTER CRAFT

[76] Inventor: Charles K. Vrana, 60 Helen Lane, Fort Myers Beach, Fla. 33931

[22] Filed: Sept. 15, 1975

[21] Appl. No.: 613,206

[52] U.S. Cl. ..... 115/22; 115/31

[51] Int. Cl.[2] ..... B63H 16/12

[58] Field of Search ..... 115/21, 22, 25, 26, 115/31–33, 28 R, 29, 30; 114/61

[56] References Cited

UNITED STATES PATENTS

| | | | |
|---|---|---|---|
| 378,613 | 2/1888 | Olsen | 115/22 X |
| 2,956,534 | 10/1960 | Archer | 114/61 |

FOREIGN PATENTS OR APPLICATIONS

| | | | |
|---|---|---|---|
| 673,183 | 10/1964 | Italy | 115/21 |

*Primary Examiner*—Trygve M. Blix
*Assistant Examiner*—Sherman D. Basinger

[57] ABSTRACT

A recreational water scooter craft to travel on the surface of the water comprising a pair of parallel, spaced apart elongated float members, a deck connecting between the floats, a compound scissors linkage connected between an operating lever and a flap oar to amplify the distance of travel of the flap oar and the resulting speed of the craft when the operating lever is actuated by a person positioned in a seat area of the craft, and a foot actuated lever is provided to actuate a rudder for steering purposes.

7 Claims, 4 Drawing Figures

BUOYANT WATER SCOOTER CRAFT

FIELD OF THE INVENTION

The present invention is directed to a recreational buoyant water craft, operated by a person seated on a seat of a deck portion of the craft. Travel distance amplifying means are interconnected between a hand operated lever and a flap oar to propel the craft along the surface of the water with each power stroke imparted to said hand operated lever by the occupant of the craft. The amplifying means increases the travel distance of the flap oar with a resulting speed increase of the craft.

OBJECTS AND ADVANTAGES OF THE PRESENT INVENTION

One of the principal objects of the present invention is to provide a simple and inexpensive water scooter craft to travel along the surface of the water by means of hand operated power to provide for recreational fun, pleasure and exercise.

Another object of the present invention is to employ a mechanical amplifying device in the form of a compound expansion scissors linkage to multiply the distance of travel of the power and recovery strokes imparted to a flap oar, by a manually operated lever.

Another object of this invention is to provide a pivotal flap oar which is designed to dig into the water to propel the craft forward on each power stroke and to move to a generally horizontal position in the water on each recovery stroke to effect a minimal degree of water resistance thereon.

A further object of the present invention is to provide a silent, pollution free, economical water craft which is light in weight, is hand operated and foot steered, and is exceptionally efficient in operation, suitable for a competative racing craft.

DETAILED DESCRIPTION OF THE DRAWINGS

Figure 1:
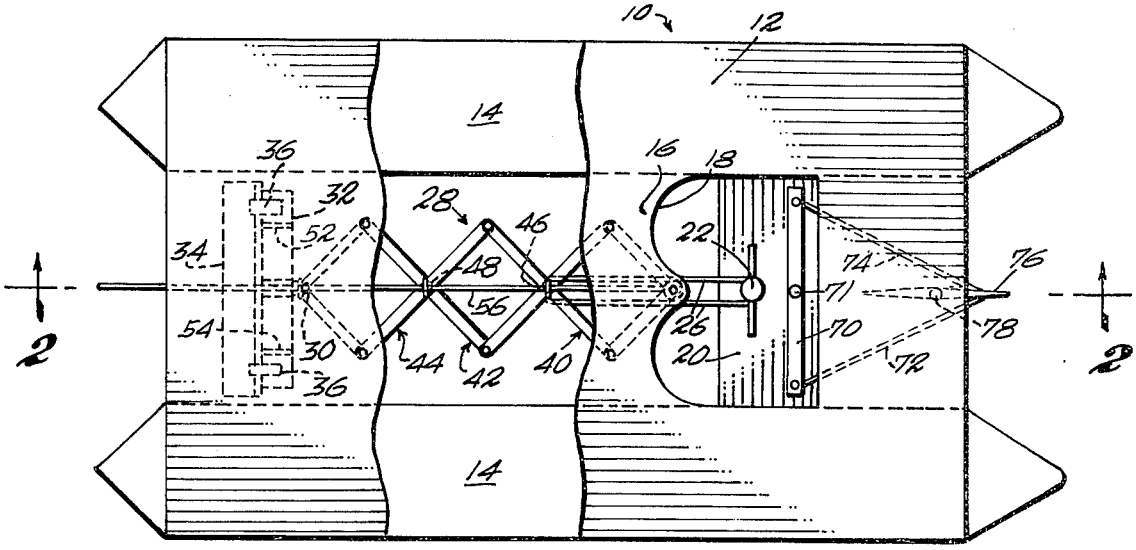
FIG. 1 is a top plan view of the water scooter craft of the present invention.
Figure 2:
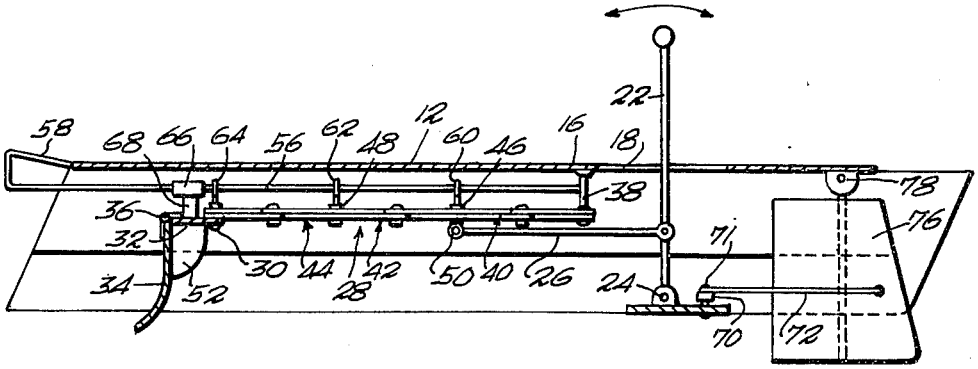
FIG. 2 is a longitudinal sectional view taken along line 2—2 of FIG. 1.
Figure 3:
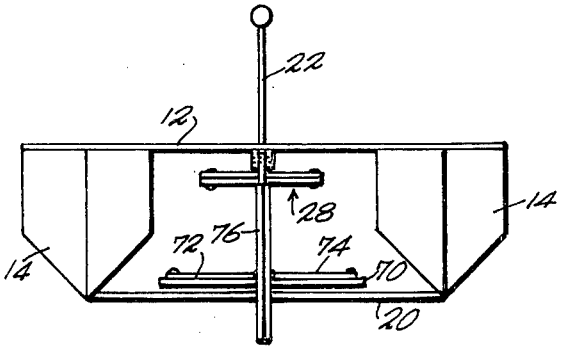
FIG. 3 is a front elevational view of the water craft as seen in FIG. 1.
Figure 4:
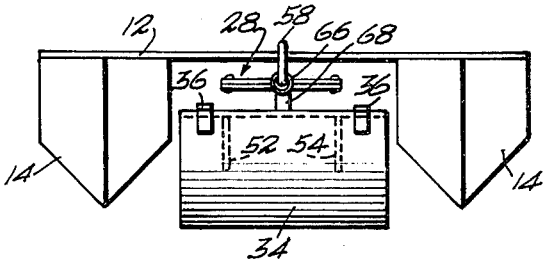
FIG. 4 is a rear elevational view thereof.

With reference to the drawings, the numeral 10 generally designates the water scooter craft of the present invention in which like reference characters designate like or corresponding parts throughout the various views. With particular reference to FIGS. 1 and 2, a deck 12 extends in a covering relation across the top of a pair of spaced apart, parallel, elongated pontoons or float members 14—14, formed of a suitable foam plastic material or of water-tight rigid hollow shells.

The deck provides a seat portion 16 and a cut out portion 18, forwardly thereof to provide for access to a foot rest 20, fixed to and spanning the lower portion of the float members 14—14.

Comprising the propulsion unit is an upwardly extending operating lever 22 pivotally attached at 24 centrally of the foot rest 20. Operating lever 22 is pivotally linked to a parallel rod member 26 which in turn is linked to a compound expansion and contraction scissors linkage 28.

As best illustrated in FIGS. 1 and 2, the scissors linkage 28 extends rearwardly to a pivotal connection 30 to a transverse plate 32 having a normally downwardly extending flap oar 34 hinged at 36 thereto. With reference to FIG. 2, the forward end of the scissors linkage is pivotally anchored at 38 to the underside of the deck 12 just rearwardly of the cut-out 18.

The scissors linkage 28 as illustrated, is comprised of three sets of scissors links 40, 42 and 44 which are intermediately pivotally connected at 46 and 48, and the parallel operating links 26 are pivotally connected at 50 to the forward pivotal connection 46. When the operating lever 22 is manually pivoted back and forth, the links 26 cause the flap oar 34 to move a distance equal to three times the travel movement of links 26. It should be understood that by varying the number of link sets such as 40, 42 and 44, the ratio of the distance movements of the flap oar 34 to the distance movements of the operating lever 22 can be varied.

On the rearward power stroke of operating lever 22, the flap oar 34 digs into the water in the position of FIG. 2, and propells the craft forwardly. A pair of back-up fins 52 and 54 maintain the flap oar 34 in the driving position. When the operating lever 22 is pivoted forwardly, the flap oar 34 trails outwardly and rearwardly in a generally horizontal attitude to provide a recovery stroke with a minimum of water resistance.

A guide rod 56 extends from the anchor 38 to the rear end of the deck 12 as at 58 and a plurality of rings 60, 62 and 64 carried by the scissors linkage 28 are slidably carried by the guide rod 56 for support purposes. A slide sleeve 66 is similarly engaged on the guide rod 56 to stabilize the transverse plate 32 and flap oar 34. A connector 68 is fixed between the plate 32 and slide sleeve 66.

A transverse foot actuated bar 70 is centrally pivoted at 71 to the foot rest 20. Means, such as steering cables or rods 72 and 74 are connected between opposed end portions of the foot bar 70 and a rudder 76, pivotally connected at 78 to the underside of the deck 12, to steer the craft.

In operation, each backward power stroke of the operating lever causes the scissors assembly 28 to expand in direct proportion to the number of sets of scissors links involved in the assembly, causing the flap oar 34 to dig into the water and to move a like distance to propel the craft forwardly along the surface of the water. Each forward, recovery stroke causes the scissors assembly 28 to retract causing the flap oar 34 to pivot to a generally horizontal attitude resulting in a minimal water resistance thereon. The directions of travel of the craft are controlled by the foot operated rudder 76.

It should be understood however that various other craft design can be constructed without departing from the spirit of this disclosure.

What is claimed is:

1. A buoyant water scooter craft comprising

A. a pair of spaced apart, parallel float members,

B. a deck, fixed to the top sides of said floats and spanning the distance therebetween, said deck including, 1. a seat portion, and 2. a cut out portion forwardly of said seat portion;

C. a foot rest fixed to and spanning the distance between said float members beneath said cut out portion;

D. a generally upstanding operating lever pivotally connected to said foot rest at its lower end for back and forth pivotal movement;

E. a flap pivotally connected in a transverse relation between and adjacent the rear ends of said float members;

F. a drive means connecting between said operating lever and said flap oar to impart a back and forth reciprocating movement to said flap oar upon actuation of said operating lever;

G. a rudder, vertically, centrally, pivotally mounted forwardly of said foot rest, and means to actuate said rudder for steering purposes.

2. A water scooter craft as defined in claim 1 wherein said rudder is pivotally mounted to the under side of said deck forwardly of said cut-out portion and said means to actuate comprises a pivotal, transverse foot actuated bar and connection means from the opposed end portions thereof to corresponding sides of said rudder, said foot actuated bar being centrally, pivotally connected to said foot rest.

3. A buoyant water scooter craft comprising

A. a pair of spaced apart, parallel float members,

B. a deck, fixed to the top sides of said floats and spanning the distance there-between, said deck including, 1. a seat portion, and 2. a cut out portion forwardly of said seat portion;

C. a foot rest fixed to and spanning the distance between said float members beneath said cut out portion;

D. a generally upstanding operating lever pivotally connected to said foot rest at its lower end for back and forth pivotal movement;

E. a flap oar pivotally connected in a transverse relation between and adjacent the rear ends of said float members;

F. a drive means connecting between said operating lever and said flap oar to impart a back and forth reciprocating movement to said flap oar upon actuation of said operating lever;

G. said drive means comprises a longitudinally extending compound scissors linkage pivotally anchored at its front end relative to said deck and at its rear end relative to said flap oar, and H. a pivotal linkage connection between said operating lever and said scissors linkage intermediate said front and rear ends.

4. A water scooter craft as defined in claim 3 including a guide means for said compound scissors linkage.

5. A water scooter craft as defined in claim 4 wherein said guide means comprises a guide rod, fixed relative to said deck, extending the length of said compound scissors linkage, and a plurality of rings, carried by said compound scissors linkage, engaged about said guide rod.

6. A water scooter craft as defined in claim 5 including a transverse plate, fixed relative to the rear end of said compound scissors linkage and flap oar, said flap oar being hinged to the trailing edge of said transverse plate.

7. A water scooter craft as defined in claim 6 including a slide sleeve fixed centrally of said transverse plate and slidably engaged over said guide rod.

* * * * *